US011152173B2

(12) United States Patent
Ebbinghaus et al.

(10) Patent No.: US 11,152,173 B2
(45) Date of Patent: Oct. 19, 2021

(54) METHOD FOR OPERATING THE DRIVE OF A VACUUM INTERRUPTER, AND VACUUM INTERRUPTER ITSELF

(71) Applicant: ABB Schweiz AG, Baden (CH)

(72) Inventors: Werner Ebbinghaus, Waltrop (DE); Dietmar Gentsch, Ratingen (DE); Christian Reuber, Willich (DE)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 16/904,580

(22) Filed: Jun. 18, 2020

(65) Prior Publication Data

US 2020/0321174 A1 Oct. 8, 2020

Related U.S. Application Data

(63) Continuation of application No. PCT/EP2018/085087, filed on Dec. 14, 2018.

(30) Foreign Application Priority Data

Dec. 21, 2017 (EP) ..... 17209273

(51) Int. Cl.
*H01H 33/666* (2006.01)
*H01H 9/30* (2006.01)

(52) U.S. Cl.
CPC ..... *H01H 33/666* (2013.01); *H01H 9/30* (2013.01); *H01H 2009/307* (2013.01)

(58) Field of Classification Search
CPC ..... H01H 33/666; H01H 33/664; H01H 2033/6668; H01H 2009/307; H01H 9/30
USPC ..... 218/140, 120, 134, 139; 200/82 B, 82 T; 324/424, 405
See application file for complete search history.

(56) References Cited

U.S. PATENT DOCUMENTS

| | | | | |
|---|---|---|---|---|
| 3,920,941 | A * | 11/1975 | Hundstad | H01H 33/666 218/140 |
| 4,381,436 | A * | 4/1983 | Nagaoka | H01H 33/982 218/61 |
| 5,747,766 | A * | 5/1998 | Waino | H01H 33/666 218/140 |
| 6,331,687 | B1 | 12/2001 | Dunk et al. | |
| 8,269,590 | B2 | 9/2012 | Bjerknes | |
| 2004/0061504 | A1 | 4/2004 | Krafft et al. | |
| 2004/0124178 | A1 | 7/2004 | Kusserow et al. | |
| 2012/0268223 | A1 | 10/2012 | Reuber | |

FOREIGN PATENT DOCUMENTS

| | | | |
|---|---|---|---|
| DE | 3815805 | A1 | 11/1989 |
| EP | 1292960 | B1 | 3/2003 |
| RU | 2528615 | C2 | 9/2014 |
| RU | 2554075 | C2 | 6/2015 |
| WO | WO 02058091 | A1 | 7/2002 |

* cited by examiner

*Primary Examiner* — William A Bolton
(74) *Attorney, Agent, or Firm* — Leydig, Voit & Mayer, Ltd.

(57) ABSTRACT

A method for operating a drive of a vacuum interrupter in opening mode includes: dividing an opening movement of at least one movable contact into serial phases, an opening phase, and an isolating phase, driven in at least two different velocities. In the opening phase a velocity of the opening movement is lower than in the isolating phase.

9 Claims, 4 Drawing Sheets

METHOD FOR OPERATING THE DRIVE OF A VACUUM INTERRUPTER, AND VACUUM INTERRUPTER ITSELF

CROSS-REFERENCE TO PRIOR APPLICATION

This application is a continuation of International Patent Application No. PCT/EP2018/085087, filed on Dec. 14, 2018, which claims priority to European Patent Application No. EP 17 209 273.6, filed on Dec. 21, 2017. The entire disclosure of both applications is hereby incorporated by reference herein.

FIELD

The invention relates to a method for operating the drive of a vacuum interrupter in opening mode, wherein the opening movement of at least one movable contact is divided into serial phases, an opening phase and an isolating phase, driven in at least two different velocities.

BACKGROUND

Circuit breakers with vacuum interrupters (VI) are usually being designed for closing and opening under short circuit conditions. Regarding the opening operation, the increase of the distance of the separated contacts of the VI has to be fast; otherwise there is a risk that the arc re-ignites after the first current zero because of the low distance of the contacts and accordingly because of the low electric strength of the VI. Under short circuit conditions, this arc generates considerable heat in the contacts of the VI, which can damage the contacts.

Not considering short circuit currents, but nominal loads, like e.g. motors or transformers, having mainly a resistance $R_{Load}$ and an inductance $L_{Load}$, the opening of the VI contacts can generate reignitions. This effect occurs after the load current is interrupted by the VI. The energies that are inside the load circuit and inside the stray capacitance $C_{cable}$ of the cable between the VI and the load will start to oscillate. This oscillation will generate a sinusoidal voltage at the cable with a typically higher frequency than the frequency of the network. The magnitude of the voltage of this oscillation will typically be higher than the voltage of the network. The resulting voltage at the open contacts of the VI can therefore reach high values, that can also be higher than the momentary electric strength of the VI, as the VI contacts are still in the phase where their distance is increased and the full electric strength is not yet reached. The electric breakdown that then can occur will result in a very fast change of the voltage over the VI contacts and also in a very fast change of the voltage at the side of the cable that is connected to the circuit breaker. This voltage step will travel through the cable and can damage the insulation of the windings of the load.

Often, the load is protected by additional means like snubber circuits or voltage arrestors. The latter reduce the magnitude and the probability of the voltage steps.

In a well known state of the art (EP 1 292 960 B1), the first opening phase is driven with maximum velocity, and then slowed down in the isolating phase, until the relative contact position reaches the end position of an opened switch.

SUMMARY

In an embodiment, the present invention provides a method for operating a drive of a vacuum interrupter in opening mode, comprising: dividing an opening movement of at least one movable contact into serial phases, an opening phase, and an isolating phase, driven in at least two different velocities, wherein in the opening phase a velocity of the opening movement is lower than in the isolating phase.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
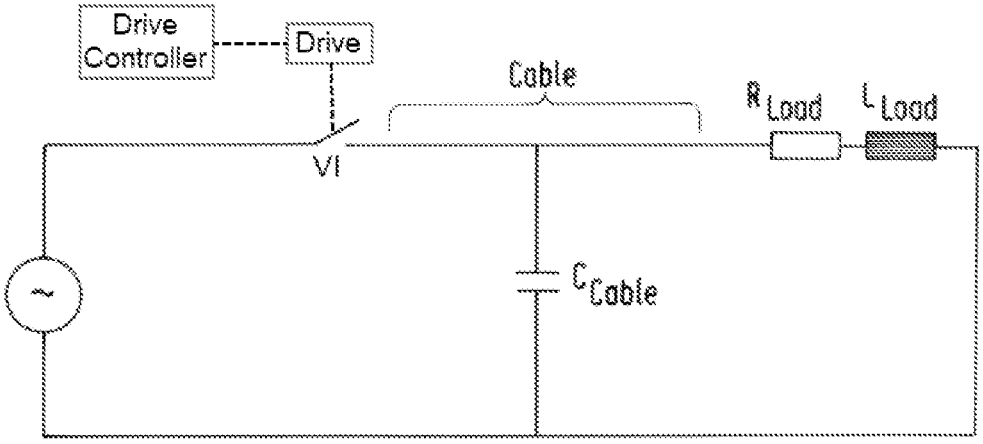
FIG. 1: The considered electrical circuit

In an embodiment, the present invention steers the opening movement of a vacuum interrupter in such, that in case of nominal or less load current, the inductive energy of the complete electrical circuit will be damped more effectively.

The present invention proposes to open the VI intentionally slow in case of a nominal load current interruption, to reduce the magnitude of the voltage steps of possible re-ignitions.

Referred to what is said to the state of the art above, basical for the invention is, that in difference to the above cited state of the art, the velocities will be used in an inverted way.

That means, if a nominal or less current load will be detected, the closed contacts are opened with a slower velocity during the opening phase, and with a higher velocity during the isolation phase.

So, that means, the invention is, that in the opening phase, the velocity of the opening movement is lower, than in the isolating phase.

This is definitively inverted, to the well known proceeding in the aforesaid state of the art.

In an advantageous embodiment for the method, the aforesaid opening movement will be initiated via the drive, if on the referring electrical circuit actually a lower, not maximal current load is detected via a current sensor. This is the case for the normal service condition, i.e. the method presented here is not intended for interrupting short circuit currents. To avoid high thermal stress at the contacts in case of currents that are higher than the nominal load current, the drive and control of the circuit breaker shall be able to distinguish between the interruption of a nominal load current and a short circuit current. Currents distinctly higher than the nominal load current, or short circuit currents, shall be interrupted with a high speed opening movement of the contacts, comparable to a state of the art circuit breaker.

In a further advantageous embodiment, the voltage oscillation in the cable of the switched circuit is measured, and the switching movement velocity is additionally steered along the switching movement, by actual consideration of the amplitude of aforesaid detected voltage oscillation.

According to a vacuum interrupter, operated according to the aforesaid method, the invention is, that in the opening phase the velocity of the opening movement is steered via a drive controller as being lower, than in the isolating phase.

In a further advantageous embodiment, the drive controller is communicating with a current sensor, placed in the electrical circuit of the vacuum switch, in such, that the aforesaid opening movement will be initiated via the drive, if on the referring electrical circuit actually a lower, not maximal current load is detected via the current sensor.

In a further advantageous embodiment, the drive controller is communicating with a voltage sensor, placed in the electrical circuit of the vacuum switch, in such, that the voltage oscillation in the cable of the switched circuit is measured, and the switching movement velocity is additionally steered along the switching movement, by actual consideration of the amplitude of aforesaid detected voltage oscillation.

In a final advantageous embodiment, the vacuum interrupter is used for medium voltage.

So in the invention, the velocities are inverted in comparison to the well known switching characteristics.

During the opening of the VI, the electrical strength is increased while the oscillation of the load circuit takes place.

With fast opening of the VI, the electrical strength is increasing fast, and it takes a relatively long time until the next breakdown occurs. The breakdown voltage will then have a relatively high value with the consequence of a high electrical stress of the load.

With slow opening of the VI, the electrical strength is increasing slowly, and it takes only a relatively short time until the next breakdown occurs. The breakdown voltage will then have a relatively low value with the consequence of a relatively low electrical stress of the load, as the magnitude of the voltage step is reduced.

FIG. 1 shows the considered electrical circuit comprising an AC voltage source, the VI as a switch, the cable represented by its capacity $C_{Cable}$ and the load represented by its resistance $R_{Load}$ and its inductance $L_{Load}$.

Figure 2:
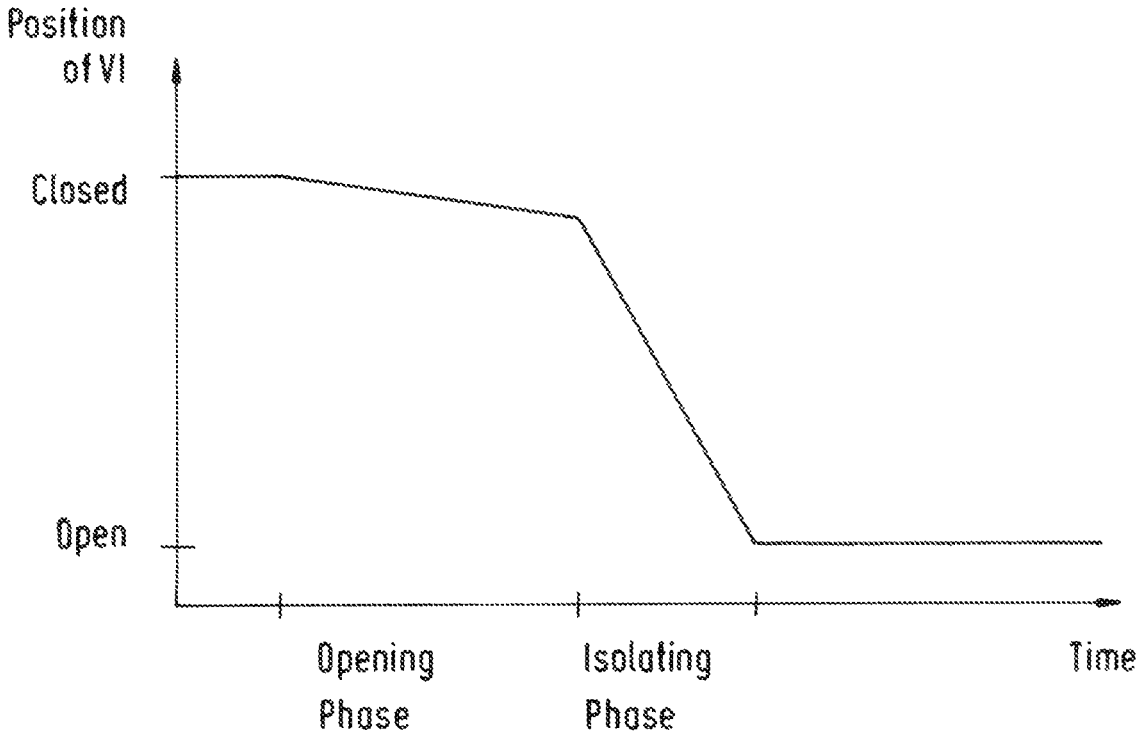
FIG. 2: The principle of opening the VI contacts slowly at first during the opening phase and then faster to reach the final position

FIG. 2 shows the transition of the movable VI contact from the closed position to the open position over time. At the begin, the VI contacts are closed. During the opening phase, the movable contact is slowly driven away from the fixed contact. During the insulating phase, the movable contact is driven faster, until it has reached the fully open position.

Figure 3:
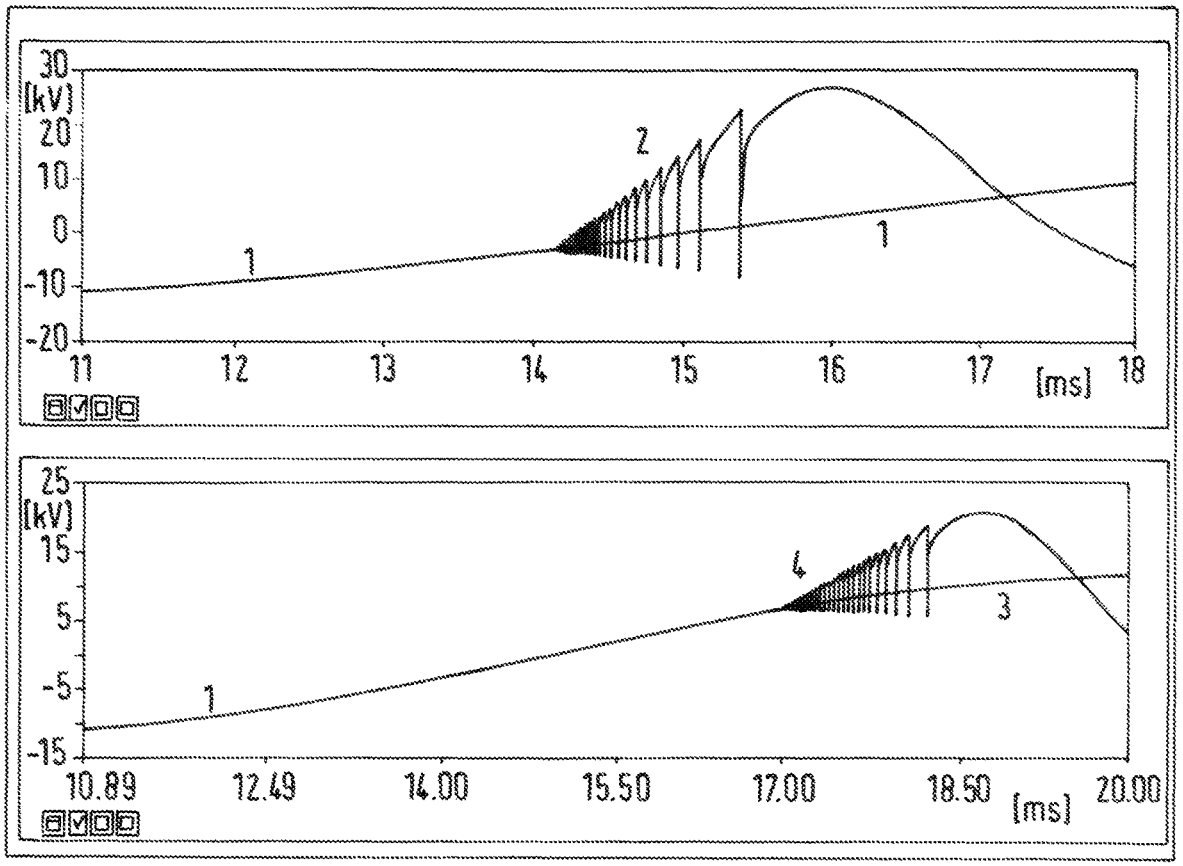
FIG. 3: Simulation showing the damping effect on the reignitions

FIG. 3 shows the principal difference in a simulation of the opening operation with high speed (upper curves) and with low speed (lower curves), using the circuit shown in FIG. 1. Curves 1 and 3 are the network voltages, while curves 2 and 4 are the voltages of $C_{Cable}$. With slow opening, the voltage steps of curve 4 are clearly lower than the voltage steps of curve 2

Using this effect, additional means for load protection, like snubber circuits or voltage arrestors, may become obsolete, depending on the actual application.

A current probe or sensor and a protection device can determine if the intended opening operation is a short circuit current opening or a nominal load current opening. In case of a short circuit current opening, the operation has to be performed with the normal VI speed, while in case of a nominal load current opening, the operation shall be performed with a reduced speed.

The design of the drive of the circuit breaker certainly has to support this approach, e.g. by the introduction of an additional damping device for the slow speed opening operation, or by the application of a servomotor with speed control and/or position control for driving the circuit breaker.

Figure 4:
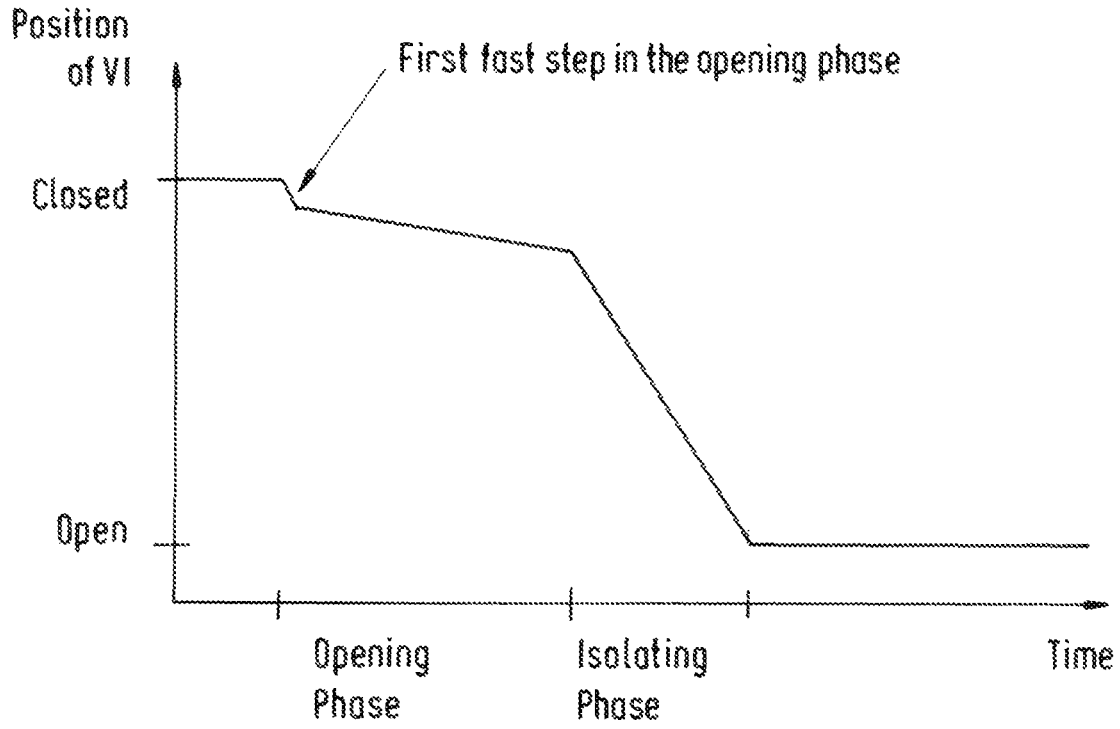
FIG. 4: Variant of FIG. 2 with a first fast step in the opening phase

Opening with slow speed also includes the idea to change the speed during the opening operation, e.g. to obtain a certain distance of the VI contacts fast, then reducing the speed to practically maintain this distance for a longer time, until the energy of the oscillation of the load circuit is below a limit where re-ignitions can occur, and then increasing the speed again to reach the fully open position, as shown in FIG. 4.

The proposed method is also advantageous for switching capacitors. In a conventional circuit breaker, the capacitor current will be interrupted at current zero, i.e. at the maximum of the network voltage. In case of slow opening, there will be several re-ignitions within the first 5 ms after current zero, so that the remaining voltage at the capacitor can be much closer to zero.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A method for operating a drive of a vacuum interrupter in opening mode, comprising:

dividing an opening movement of at least one movable contact into serial phases, an opening phase, and an isolating phase, driven in at least two different velocities, wherein in the opening phase a velocity of the opening movement is slower than in the isolating phase.

2. The method according to claim 1, wherein the opening movement is initiated via the drive if on a referring electrical circuit a current not higher than a nominal load current is detected via a current sensor.

3. The method according to claim 1, wherein for currents higher than a nominal load current, an entire opening operation is performed with a high speed.

4. The method according to claim 1, wherein a voltage oscillation in a cable of the switched vacuum interrupter is measured, and a switching movement velocity is additionally steered along a switching movement by actual consideration of an amplitude of a detected voltage oscillation.

5. The method according to claim 1, wherein the opening phase starts with a first step and is then followed by a second step, the first step being faster than the second step.

6. The vacuum interrupter, comprising:

the drive configured to switch contacts of the vacuum interrupter, wherein the opening movement of at least one movable contact is divided into serial phases, the opening phase, a disconnecting phase, and the isolating phase, driven in at least two different velocities, operated by the method according to claim 1, wherein in the opening phase and/or disconnecting phase the velocity of the opening movement is steered via a drive controller as being slower than in the isolating phase.

7. The vacuum interrupter according to claim 6, wherein the drive controller is configured to communicate with a current sensor placed in an electrical circuit of the vacuum interrupter such that the opening movement will be initiated via the drive if on a referring electrical circuit a lower, not maximal current load is detected via the current sensor.

8. The vacuum interrupter according to claim 6, wherein the drive controller is configured to communicate with a voltage sensor placed in an electrical circuit of the vacuum interrupter such that a voltage oscillation in a cable of the switched vacuum interrupter is measured, and wherein a switching movement velocity is additionally steered along a switching movement by actual consideration of an amplitude of a detected voltage oscillation.

9. The vacuum interrupter according to claim 6, wherein the vacuum interrupter is used in medium voltage.

* * * * *